US005408947A

United States Patent [19]

Curto et al.

[11] Patent Number: 5,408,947

[45] Date of Patent: Apr. 25, 1995

[54] MARINE TOWING SYSTEM AND METHOD

[75] Inventors: Rick A. Curto, Friendswood; Tom E. Hickman, Sugarland; Philip J. Jenkins, Pearland, all of Tex.

[73] Assignee: Western Atlas International, Inc., Houston, Tex.

[21] Appl. No.: 74,219

[22] Filed: Jun. 9, 1993

[51] Int. Cl.[6] ..... B63B 21/04

[52] U.S. Cl. ..... 114/253

[58] Field of Search ..... 114/242, 244, 245, 253, 114/254, 246

[56] References Cited

U.S. PATENT DOCUMENTS 1,395,924 11/1921 Magoun ..... 114/253

4,249,324 2/1981 Latimer ..... 114/246

4,721,180 1/1988 Haughland et al. ..... 114/253

4,756,268 7/1988 Gjestrum et al. ..... 114/253

4,890,568 1/1990 Dolengowski ..... 114/253

*Primary Examiner*—Stephen P. Avila

*Attorney, Agent, or Firm*—Elizabeth W. Layman

[57] ABSTRACT

A method and apparatus in marine seismic surveying for towing an optical-electrical towing cable (leadin) and seismic array (streamer cable) at a perpendicular distance from the centerline of the towing vessel using a short, flexible adapter cable section which optically and electrically connects the leadin to the streamer cable and which attaches to pivoting arms of a removable towing bracket which carries the bending loads.

2 Claims, 4 Drawing Sheets

MARINE TOWING SYSTEM AND METHOD

BACKGROUND OF THE INVENTION

1. Field of the Invention

The present invention relates generally to a method and an apparatus for use in marine seismic exploration and more particularly to a method and apparatus for deployment of a marine seismic cable.

2. Description of Related Art

In the field of seismic exploration, it is important to determine the configuration of the rock strata underlying the earth's surface to locate subsurface structures favorable to the existence of oil and gas. In marine seismic surveying, this is accomplished by generating acoustic pulses or shock waves by sound sources such as air guns and by monitoring the resultant acoustic waves which reflect off the subsea structures by sensors such as hydrophones. In operation, the seismic sound sources and the hydrophones are towed in designated patterns behind a seismic vessel.

As the vessel moves over the area being surveyed, the seismic sound sources are activated. The sensors detect the reflected acoustic waves and provide optical and/or electrical signals (information) representative of such acoustic waves. The signals from the sensors are relayed to apparatus aboard the vessel. The signals from the sensors are processed to display maps which show the thickness and orientation of the various strata underlying the sea bed.

Commonly, an array of hydrophones is configured as a cable having a flexible jacket typically made from polyurethene or similar material. This configuration is called a streamer cable. To optimally develop marine surveys covering a wide area, multiple streamer cables are deployed in a pattern parallel to the centerline of the vessel. The streamer cables are separated from each other by desired distances to cover the marine surveying area. To obtain the required lateral distance between adjacent streamer cables, the streamer cables are attached at predetermined tow points on the cable to devices referred in the art of seismic exploration as pullavanes or paravanes. The pullavanes are towed to the side of the vessel.

Armored, optical-electrical towing cables, referred to in the art as leadins, are used to couple the streamer cables to the apparatus on the vessel. The leadins are designed to carry axial tension loads. In conventional towing arrangements, a tow line is connected directly to the leadin and to a device, such as a pullavane, which as noted above is positioned to the side of the vessel. The leadin forms a relatively large-radius loop behind the vessel (or from a boom extended sideways from the vessel) to the tow line and then a relatively small or tight loop in the opposite direction to the point where the leadin connects to the streamer cable. Such an arrangement or configuration positions the streamer cable at a desired lateral distance from the vessel. As the cable is towed through the water during surveying operations, relatively large non-axial bending forces are applied to the leadin on both sides of the point where the tow line is attached to the leadin. Erratic cross currents also tend to subject the leadin to additional non-axial bending forces.

The strength and thus the operating life of a leadin decreases greatly when a non-axial force such as a bending force is applied on the cable. This problem is exaggerated in three-dimensional seismic surveys where streamer cables are towed at larger lateral distances from the towing vessel compared to the traditional two-dimensional seismic surveying. Such larger lateral distances result in larger non-axial, bending loads on the leadins. Therefore, the operating life of a leadin may be greatly extended by reducing the non-axial forces on the leadin during operation. A common solution has been to reinforce the area around the tow point by adding additional armor to the leadin so that the leadin bends over a relatively large radius of curvature. The larger the radius of curvature, the smaller the bending loads on the leadin.

Adding additional armor to protect against these non-axial loads increases the diameter and weight of the leadin which results in higher manufacturing and operating costs. Moreover, because of the severe bend in wide tow configurations, the additional armor does not completely compensate for the non-axial forces.

There has been a long felt, yet unsolved need for a towing system that minimizes the non-axial forces acting on the leadin without increasing the size and weight of the leadin. The present invention provides an apparatus and method for towing streamer cables that addresses the above-noted problems associated with prior art towing arrangements.

SUMMARY OF THE INVENTION

The present invention provides a method and an apparatus for towing a seismic cable for use in marine seismic exploration utilizing a novel towing bracket and flexible adapter section of seismic cable. The bracket is attached via a towline to a pullavane spatially positioned at a desired lateral offset from the centerline of the vessel. The bracket is configured with a brace and clamps for firmly holding the adapter section and with hinged arms for transforming the non-axial forces encountered by the adapter section into movement of the arms from side to side resulting in minimal non-axial load effects on the adapter section of seismic cable. For wider tow configurations, multiple towing brackets can be used to increase the lateral offset.

Examples of the more important features of the invention thus have been summarized rather broadly so that the following detailed description may be better understood and so that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Figure 1:
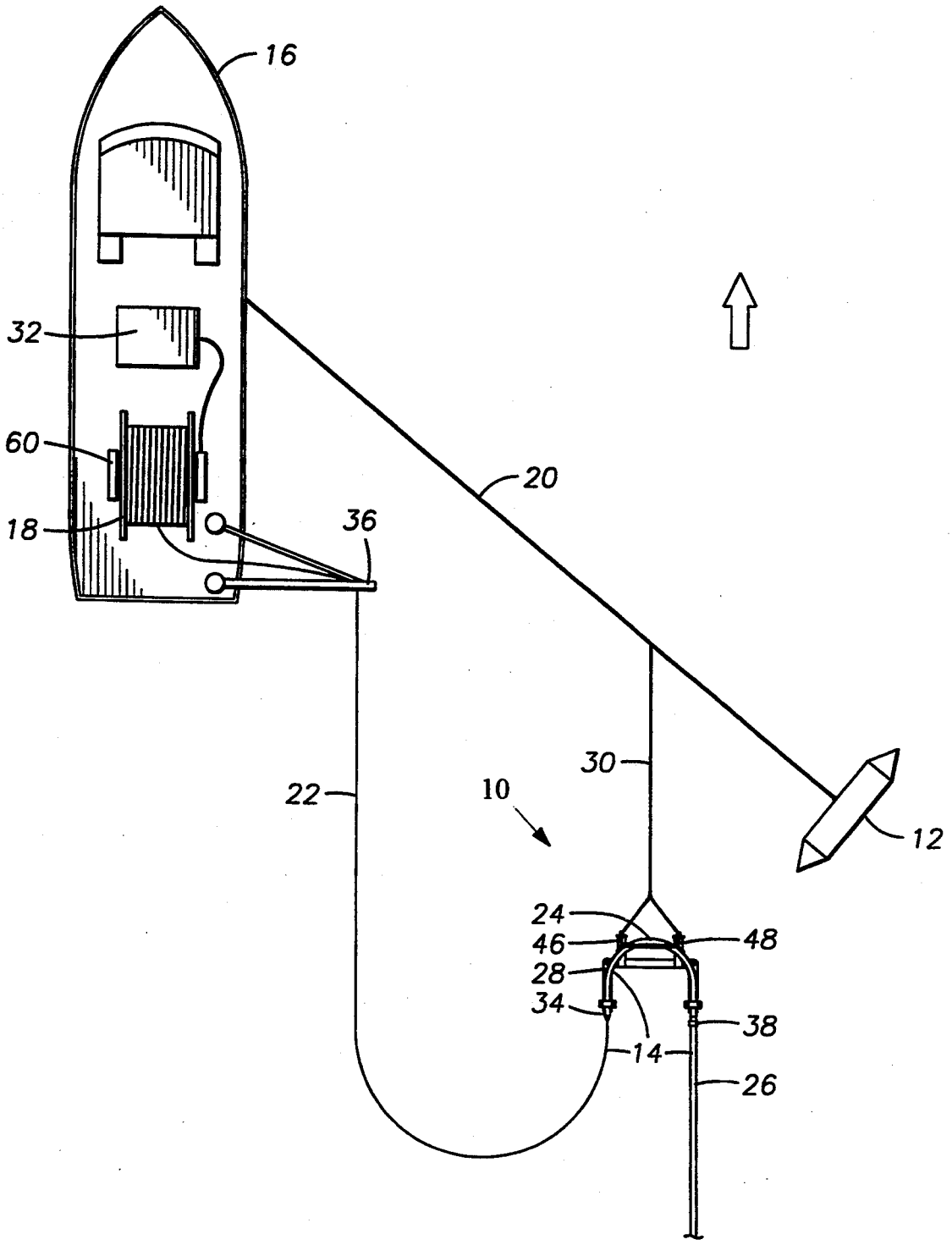
FIG. 1 shows a schematic of the towing system of the present invention placed behind a vessel and coupled to a pullavane.

FIG. 1 illustrates schematically a towing system 10 of the present invention in operation with a pullavane 12 for towing a seismic cable 14 at a lateral distance from a vessel 16. The seismic cable 14 is deployed from and retrieved onto the vessel 16 by means of a winch 18. The pullavane 12 is deployed to the side of the vessel 16 via a pullavane cable 20.

The seismic cable 14 contains a leadin 22, an adapter section 24 and a streamer cable 26. The leadin 22 is a cable which contains armor, signal and data-carrying means such as fiber optics and electrical conductors, conductors for carrying power, spacers and other elements. The armor provides desired strength as well as protection to the other elements or components in the leadin 22. Details of the leadin 22 are not shown since the construction of leadins 22 is generally known in the art of seismic exploration.

The adapter section 24 is a flexible cable with a connector at each end. The streamer cable 26 is typically 2000–5000 meters long and is made by joining smaller sections, typically 100 meters long each. Each such joined section contains a plurality of sensors, fiber optics, electronic circuits, electrical conductors, spacers and several other elements. The adapter section 24 and the streamer cable 26 are typically encased in a protective jacket or sheathing made from polyurethane or similar material and are filled with a nonconductive fluid such as kerosene, a nonconductive gel or the like.

During operation, one end of the leadin is connected to a leadin end 34 of the adapter section 24 while the streamer end 38 of the adapter section 24 is connected to one end of the streamer cable 26. This arrangement ensures proper electrical and mechanical connections between the leadin 22 and the streamer cable 26 via the adapter section 24.

The leadin 22 extends from the vessel 16 to an outrigger or a boom 36 (extended outwardly from the side of the vessel 16) and into the water behind the boom 36. Outriggers or booms 36 are mounted on each side of the stern of the vessel 16 to increase the lateral displacement between streamer cables 26. The leadin 22 then is looped at a desired radius to the towing bracket 28 where it is terminated in a watertight connection with the adapter section 24. As noted above, the other end (the streamer end 38) of the adapter section 24 is connected to the streamer cable 26 thus providing continuous fiber optic and electrical connections between the seismic apparatus 32 on the vessel 16 and the marine seismic sensing devices (not shown) in the streamer cable 26.

Figure 2:
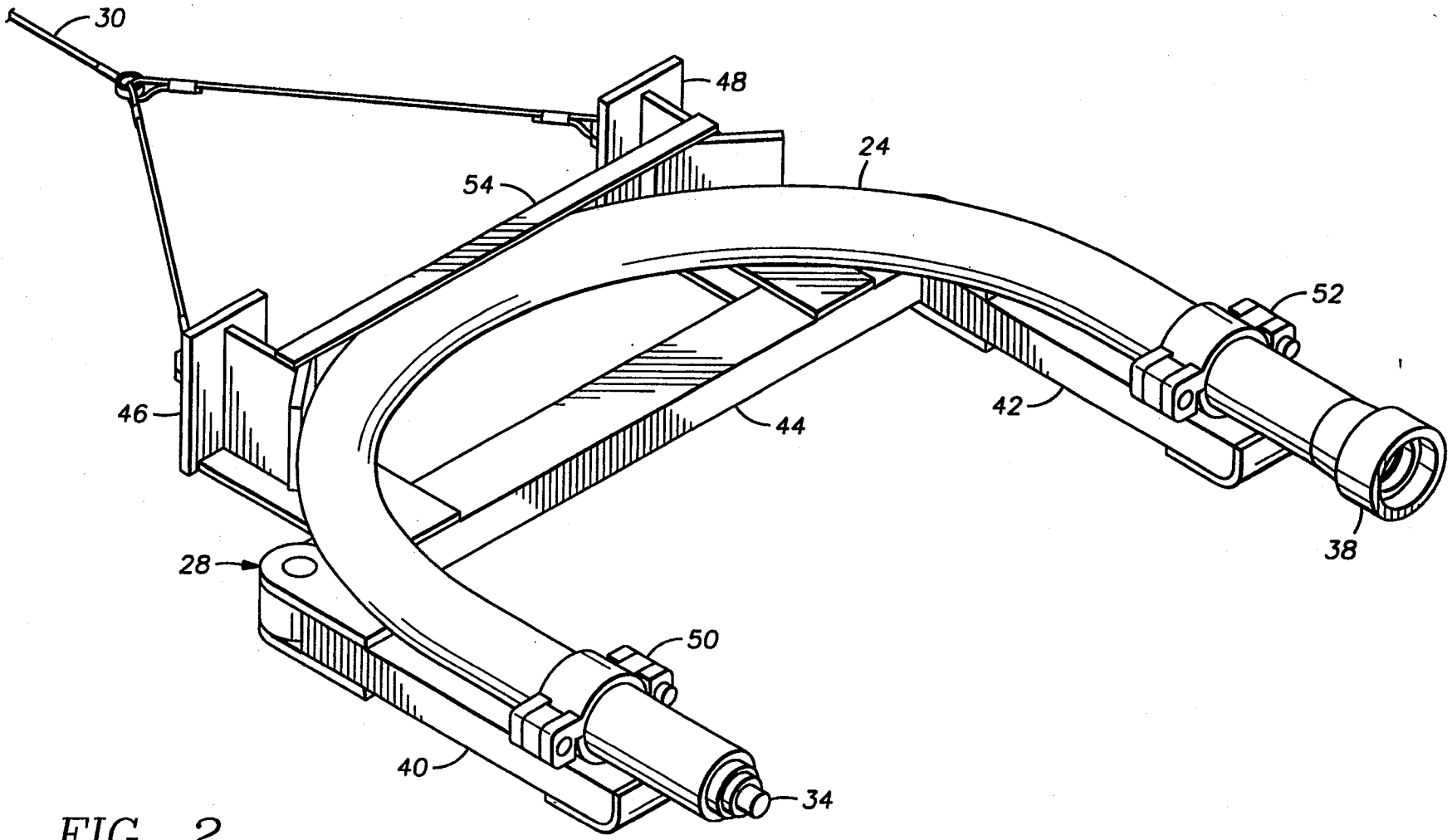
FIG. 2 is a perspective view of the towing system of the present invention having an adapter section of seismic cable section mounted on a towing bracket.

FIG. 2 shows the adapter section 24 mounted on a towing bracket 28. The towing bracket 28 contains a frame member 44. The leadin end 34 and the streamer end 38 extend over the ends of a leadin arm 40 and a streamer arm 42 of the towing bracket 28, respectively, and the center portion of the adapter section 24 rests on the frame 44 of the towing bracket 28 braced against a leadin brace 46 and a streamer brace 48. The leadin end 34 and the streamer end 38 of the adapter section 24 are releasably connected to the bracket 24 by a leadin clamp 50 and a streamer clamp 52, respectively.

The leadin arm 40 and the streamer arm 42 are hingedly connected to opposite ends of the frame 44 of the towing bracket 28 to allow non-axial forces to be translated into axial forces by the pivoting motion of the arms 40 and 42. The leadin brace 46 and the streamer brace 48 are fixedly attached to the frame 44 of the towing bracket 28 and connected to each other by a brace bar 54. The adapter section 24 is positioned beneath the brace bar 54 before the adapter section 24 is clamped to the towing bracket 28. During towing operations the brace bar 54 holds the adapter section 24 in position on the towing bracket 28.

As shown in FIG. 1, the tow line 30 is connected from the pullavane line 20 to the towing bracket 28 in a Y-arrangement with the leadin brace 46 and the streamer brace 48. This means of attachment of the towing bracket 28 to the pullavane 12 is shown for example and is not meant to limit other attachment means.

Figure 3:
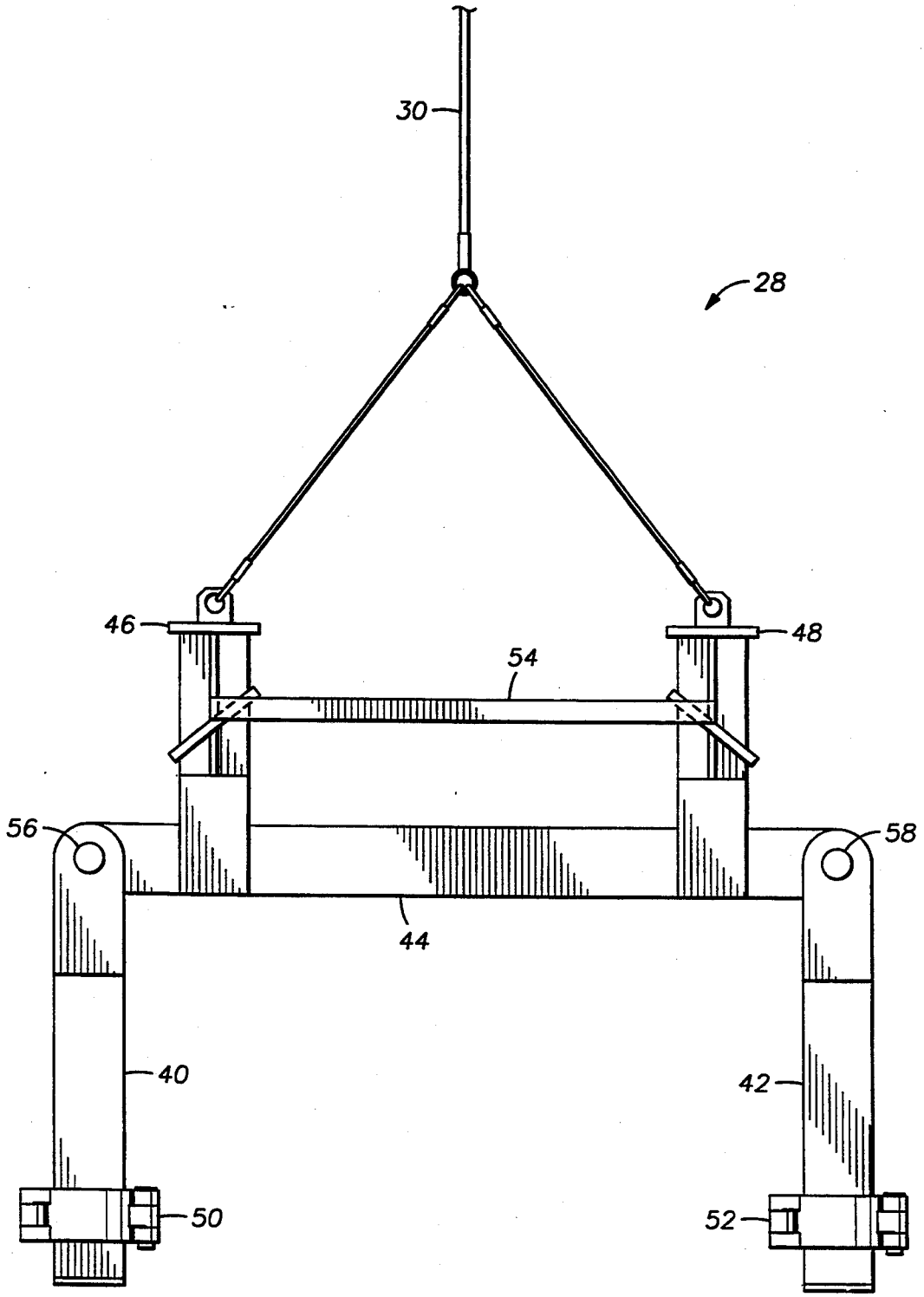
FIG. 3 shows a top view of a towing bracket.

FIG. 3 shows a top view of the towing bracket 28. In the preferred embodiment, the towing bracket 28 is U-shaped with the leadin arm 40 and the streamer arm 42 pivotally connected to opposite ends of the frame 44 and extending away from the towline 30. By connecting the arms 40 and 42 to the frame 44 with hinges 56 and 58, respectively, non-axial forces are transformed into movement of the arms 40 and 42 about the respective hinges 56 and 58 thereby minimizing the non-axial forces acting on the leadin 22 (shown in FIG. 2).

To facilitate deployment and retrieval of the seismic cable 14 (shown in FIG. 1), the adapter section 24 is easily attachable to and releasable from the towing bracket 28. As shown in FIG. 2, the adapter section 24 in the preferred embodiment is releaseably mounted on the towing bracket 28. The leadin end 34 of the adapter section 24 is sealably connected to the leadin 22 (shown in FIG. 1 ) and releasably clamped to the leadin arm 40 of the towing bracket 28 by leadin clamp 50. The adapter section 24 then is looped across the frame 44 of the towing bracket 28 such that the adapter section 24 rests on the arms 40–42 and the frame 44, the leading edge of the adapter section 24 rests against braces 46–48, and the streamer end 38 of the adapter section 24 extends over the streamer arm 42 of the towing bracket 28. The streamer end 38 then is releasably clamped to the streamer arm 42 with the streamer clamp 52 and sealably connected to the streamer cable 26 (shown in FIG. 1).

As shown in FIG. 1, the seismic cable 14 is stored on a storage reel 60. In preparation for marine seismic surveying, the winch 18 is used to deploy the seismic cable 14 into the water behind the vessel 16. The leadin 22 can be attached to the boom 36 to extend the lateral distance to the towing bracket 28. The seismic cable 14 is released into the water starting with the streamer cable 26. The adapter section 24 is clamped onto the towing bracket 28 after it is unwound from the storage reel 60 and before it is released into the water. The tow line 30 is attached to the pullavane 12 which positions the streamer cable 26 at the proper lateral distance from the side of the vessel 16.

One deployment arrangement is shown in FIG. 1 where the leadin 22 is attached to the boom 36 and the tow line 30 is attached to the pullavane cable 20. This arrangement is shown for illustrative purposes only and does not limit the types of arrangement such as the attachment of the tow line 30 directly to the pullavane 12 (not shown).

When the marine seismic surveying has been completed, the seismic cable 14 is retrieved. One method for accomplishing this is to winch the leadin 22 onto the storage reel 60, release the adapter section 22 from the towing bracket 28 as it reaches the vessel 16 and winch the adapter section 22 and the streamer cable 26 onto the storage reel 60.

With this arrangement, the entire seismic cable 14, including the adapter section 24, is subjected to the pulling forces needed to retrieve the seismic cable and store it on the storage reel 60.

Figure 4:
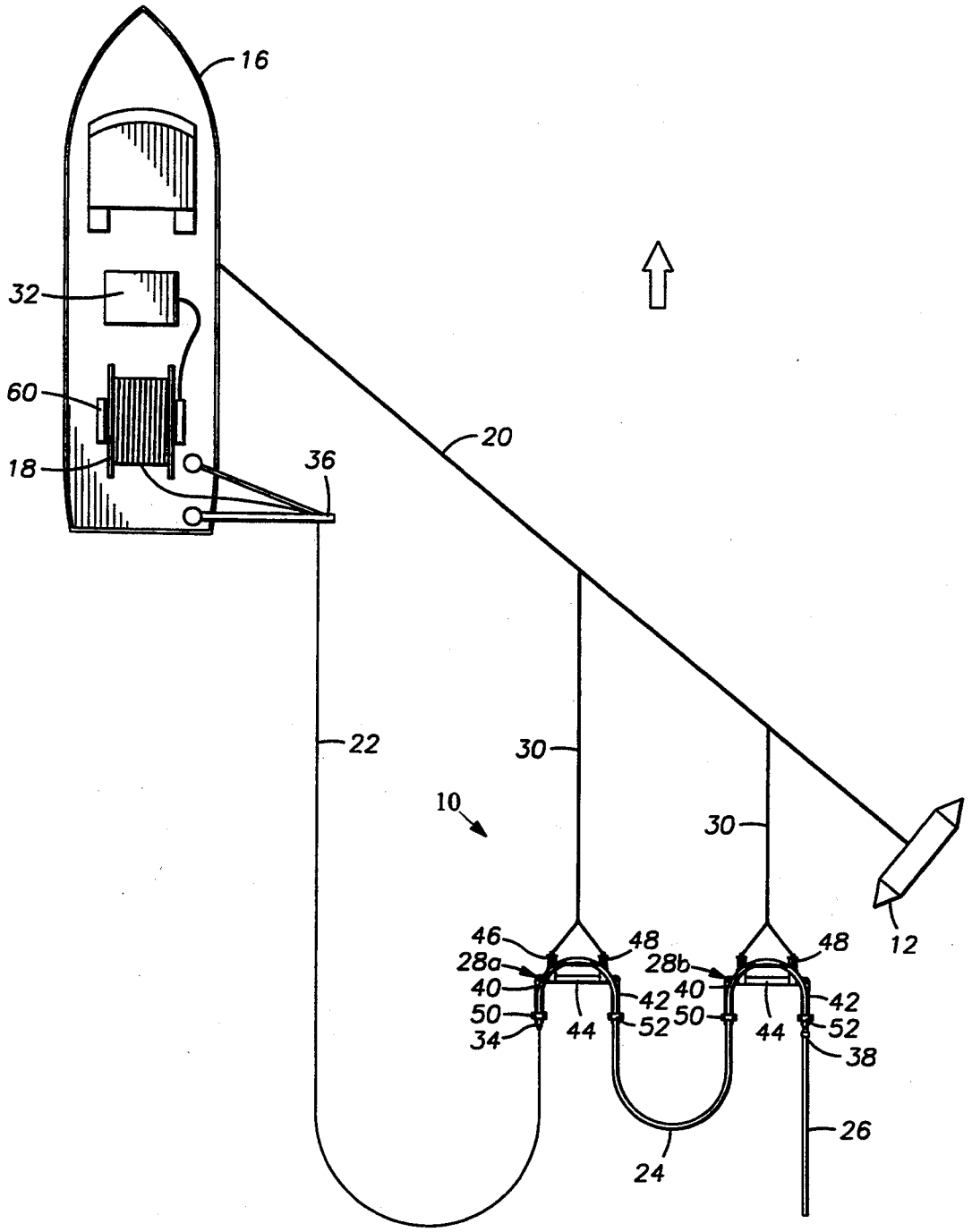
FIG. 4 shows a plan view of the towing system of the present invention utilizing multiple bracket adapter systems.

For additional offset from the vessel 16, multiple towing brackets 28 can be utilized. An example of a preferred embodiment utilizing two towing brackets 28*a* and 28*b* is shown in FIG. 4. By using a continuous section of cable for the adapter section 24 across the two towing brackets 28*a* and 28*b*, no additional optic light loss is encountered from multiple connectors. Because the adapter section 24 loops between the two towing brackets 28*a* and 28*b*, however, there will be some non-axial forces and the adapter section 24 of the preferred embodiment has some armor added for protection against these forces.

As in the single towing bracket arrangement (shown in FIG. 1), the leadin end 34 of the adapter section 24 is sealably connected to the leadin 22. The leadin end 34 then is clamped to the leadin arm 40 of the first towing bracket 28*a* with leadin clamp 50, looped across the frame 44 and against the leadin and streamer braces 46 and 48 and clamped with the streamer clamp 52 to the streamer arm 42 of the first towing bracket 28*a*.

The adapter section 24 then is looped to the second towing bracket 28*b* for similar clamping to the leadin and streamer arms 40 and 42 by leadin and streamer clamps 50 and 52 of the second towing bracket 28*b*. The adapter section 24 is terminated in a watertight seal with the streamer cable 26 to complete the assembly.

The foregoing description of the invention is intended to be a description of a preferred embodiment. Various changes in the details of the described apparatus and method may be made without departing from the scope of the invention.

What is claimed is:

1. A seismic towing system for use with a vessel having an electrical power supply, data signal apparatus and a pullavane connected to the vessel, comprising:

(a) a towing bracket connected to the pullavane, comprising:
  (i) a frame having a first end and a second end;
  (ii) a first arm connected to the first end of the frame and adapted to move in a horizontal plane; and
  (iii) a second arm connected to the second end of the frame and adapted to move in a horizontal plane; and (b) a seismic cable, comprising:
  (i) a leadin having an onboard end and an outboard end, wherein the onboard end is connected to the electrical power supply and the data signal apparatus on the vessel;
  (ii) a streamer section containing seismic sensors; and
  (iii) an adapter section attached to the first arm and the second arm of the towing bracket, said adapter section having a first end connected to the outboard end of the leadin and a second end connected to the streamer section to form continuous electrical power and data signal paths between the vessel and the seismic sensors.

2. A method of towing a marine cable from a vessel, wherein the marine cable has an adapter section, the method comprising the steps of:

(a) deploying a pullavane in the water to the side of the vessel, wherein the pullavane is attached to the vessel;

(b) attaching a towing bracket to the pullavane, wherein said towing bracket includes:
  (i) a frame having a first end and a second end;
  (ii) a first arm connected to said first end of said frame and adapted to move in a horizontal plane; and
  (iii) a second arm connected to said second end of said frame and adapted to move in a horizontal plane;

(c) attaching said adapter section of the seismic cable to said first arm and said second arm of the towing bracket; and (d) pulling said towing bracket to move the marine cable through the water.

* * * * *